US007018068B2

(12) United States Patent
Fan

(10) Patent No.: US 7,018,068 B2
(45) Date of Patent: Mar. 28, 2006

(54) SHAPED LAMP HANGER

(76) Inventor: Jingqiang Fan, China/Floor 2, Chaohong Furniture Company, Dazhou Administration Zone, Qiaotou Town, Dongguan City, Guangdong Province (CN)

( * ) Notice: Subject to any disclaimer, the term of this patent is extended or adjusted under 35 U.S.C. 154(b) by 231 days.

(21) Appl. No.: 10/649,278

(22) Filed: Aug. 27, 2003

(65) Prior Publication Data

US 2005/0047119 A1 Mar. 3, 2005

(51) Int. Cl.
*A63H 11/00* (2006.01)

(52) U.S. Cl. ..... 362/252; 40/414; 362/808; 446/353

(58) Field of Classification Search ..... 362/84, 362/124–125, 227, 257, 269, 272, 267, 275, 362/418, 419, 249, 806, 808; 446/236, 242, 446/237–238, 373–376, 384, 330, 335, 337, 446/352–356, 368, 370–371, 485; 40/414
See application file for complete search history.

(56) References Cited

U.S. PATENT DOCUMENTS

| | | | | |
|---|---|---|---|---|
| 1,577,903 | A * | 3/1926 | Gover et al. | 40/414 |
| 4,867,730 | A * | 9/1989 | Lee | 446/353 |
| 5,141,464 | A * | 8/1992 | Stern et al. | 446/338 |
| 6,394,282 | B1 * | 5/2002 | Pan | 211/1.51 |
| 6,413,594 | B1 * | 7/2002 | Onishi | 428/7 |
| 6,478,164 | B1 * | 11/2002 | Pan | 211/1.51 |
| 6,758,001 | B1 * | 7/2004 | Su | 40/538 |
| 6,769,954 | B1 * | 8/2004 | Su | 446/353 |

* cited by examiner

*Primary Examiner*—Sandra O'Shea
*Assistant Examiner*—Robert May
(74) *Attorney, Agent, or Firm*—McAndrews, Held & Malloy, Ltd.

(57) ABSTRACT

A movable animal-like lamp hanger has a body including a first movable portion, a plurality of ornamental lights attached to the body, a motor disposed in the body, a transmission shaft connected to the motor, and a first drive rod pivotally connected to the transmission shaft and connected to the first movable portion of the body in such an manner that when the motor drives the transmission shaft to rotate, the first drive rod can direct the first movable portion to move like a desired animal.

10 Claims, 4 Drawing Sheets

SHAPED LAMP HANGER

TECHNICAL FILED OF THE INVENTION

The present invention is directed to a lamp hanger for entertainments, and particularly to an animal-like lamp hanger that can be enjoyable and entertaining.

BACKGROUND OF THE INVENTION

There have been many lamp hangers that are shaped to be like various animals in the art. A great number of small electric bulbs are attached to the outside of the lamp hanger and the animal profile can be showed by lighting the bulbs in the dark. However, the lamp hanger disclosed in the prior art is unmovable. As a result, the lamp hanger in the art looks stiff and is lacking in entertainments.

SUMMARY OF THE INVENTION

Accordingly, the present invention is to provide a movable animal-like lamp hanger that has a compact structure and a vivid shape when used.

According to the invention, the movable animal-like lamp hanger comprises a body including a first movable portion, a plurality of ornamental lights attached to the body, a motor disposed in the body, a transmission shaft connected to the motor, and a first drive rod pivotally connected to the transmission shaft and connected to the first movable portion of the body in such a manner that when the motor drives the transmission shaft to rotate, the first drive rod can direct the first movable portion to move like a desired animal.

In an embodiment of the present invention, the movable animal-like lamp hanger further comprises a second drive rod pivotally connected to the transmission shaft, and the body further comprises a second movable portion which is connected to the second drive rod in such a manner that when the motor drives the transmission shaft to rotate, the first drive rod and the second rod can respectively drive the first movable portion and the second movable portion to move like a desired animal.

In another embodiment of the present invention, the movable animal-like lamp hanger further includes a third drive rod pivotally connected to the transmission shaft, and the body further comprises a third drive rod which is connected to the third drive rod in such a manner that when the motor drives the transmission shaft to rotate, the first drive rod, the second rod and the third rod can respectively drive the first, the second and the third movable portions to move like a desired animal.

In accordance with an embodiment of the present invention, the first, second and third drive rods may be connected with the first, second and third movable portions by means of three gimbals respectively. In a further embodiment of the invention, the first drive rod is connected with the first movable portion with a connecting member having two annuluses perpendicular to each other.

The invention can apply for various shaped animals and insects such as bees, rabbits, cattle, frogs, deer and etc., even shaped soldiers. The body can be made of plastics and metal. Various ornamental bulbs in different colors can be used to attach the outside of the body or the inside thereof in case that the body is formed in a transparent form or a grid shape. In one embodiment of the invention, the lamp hanger is shaped with a grid configuration, and the ornamental lights are attached to the inside of the body.

DETAILED DESCRIPTION OF PREFERRED EMBODIMENTS

The present invention will be described in detail with reference to the drawings.

Embodiment 1

Figure 2:
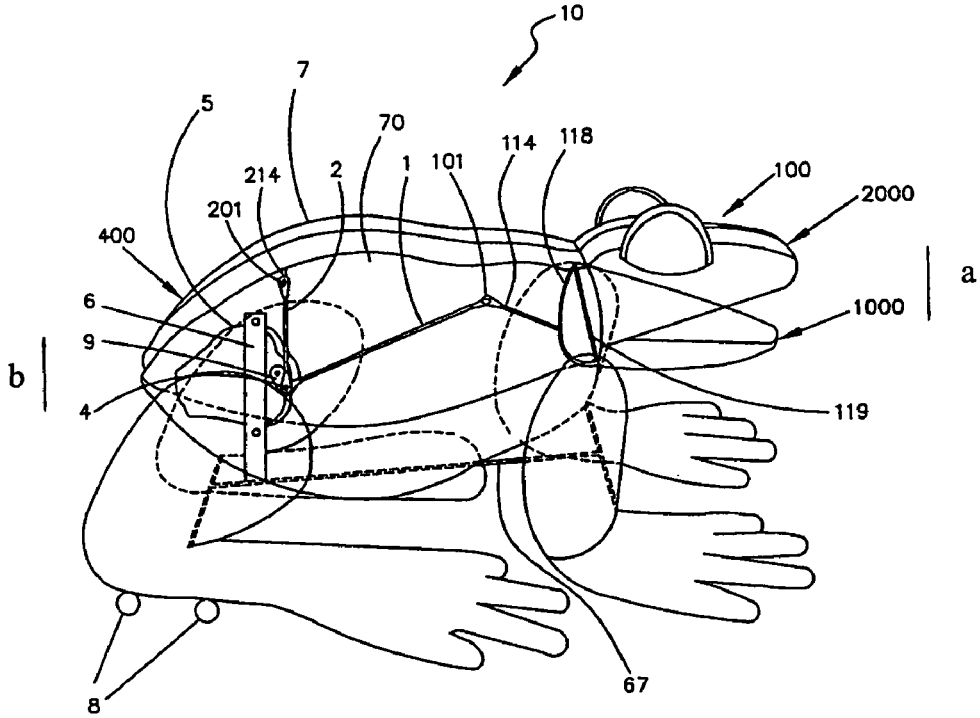
FIG. 2 shows an embodiment of the movable frog-like lamp hanger of the invention.

FIG. 2 shows an embodiment of the movable lamp hanger of the invention, in which the lamp hanger is designed in the shape of a frog 10.

The movable lamp hanger 10 in this embodiment includes a body 7 which has two movable portions, a head portion 100 and a tail (back) portion 400 disposed on a trunk 70 of the frog. A motor 5 that is connected with a power supply (not shown) is fixed to a support 6 mounted within the body 7, a transmission shaft 4 connected to the motor 5 with a crank 9. A first drive rod 1 is connected to the transmission shaft 4 with its one end, and another end thereof is connected with the head portion 100 by a first connecting bar 114. The connecting bar 114 is connected to a lower jaw portion 1000 of the head portion 100. As shown in FIG. 2, the connecting bar 114 is connected to a frame 118 of the lower jaw portion 1000, which can drive the lower jaw portion 1000 to open or close round a rotating axis 119 with respect to an upper jaw portion 2000 of the head portion 100 of the frog. A connecting member 101 is provided to connect the first drive rod 1 to the connecting bar 114. The connecting member 101 is a gimbal in this embodiment.

A second drive rod 2 is provided to connect the transmission shaft 4 with the tail portion 400. A second connecting bar 214 is fixed to the inside of the tail portion 400, and is connected with the second drive rod 2 with a gimbal 201 that is connected to a frame 205 of the neck portion. In this embodiment, the body is made of plastic, and a plurality of ornamental bulbs 8 are attached to the outside of the body.

Thus, when the motor 5 is energized, the transmission shaft 4 is driven to move circumferentially round the output shaft of the motor 5 by the crank 9. The first drive rod 1 and the second drive rod 2 are respectively driven to move. The first drive rod 1 drives the first connecting bar 114 to move and to hereby draw and pull the lower jaw portion 1000 upward and downward with respect to the upper jaw portion 2000 (in the direction of an arrow a as shown in FIG. 2). Meanwhile, the second drive rod 2 is driven to move circumferentially round the transmission shaft 4 and hereby to make the tail portion 400 move upward and downward with respect to a fixed frame 67 where the support 6 is mounted (in the direction of an arrow b as shown in FIG. 2). Because the first drive rod 1 can be designed with a different length from the second drive rod 2, the movement of the tail portion 400 is not synchronous to that of the lower jaw portion 1000. Therefore, the movable lamp hanger of the invention looks like a real frog.

Figure 4:
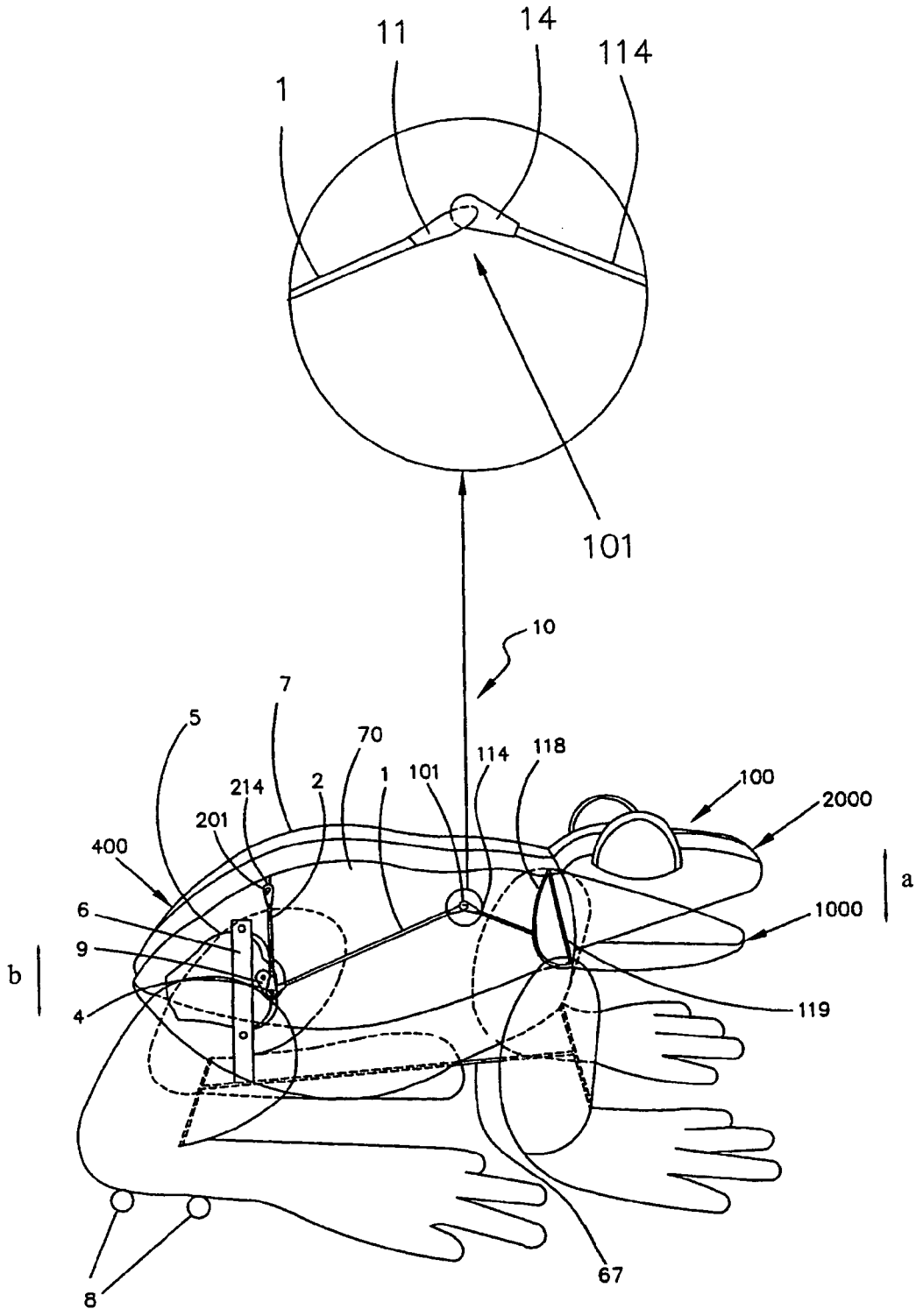
FIG. 4 shows another embodiment of the frog-like lamp hanger of the invention, which includes an enlarged view of a connecting member used.

In another embodiment of the frog-like lamp hanger of the invention as shown in FIG. 4, a connecting member 101 includes two annuluses 11, 14 perpendicular to each other. With such a structure, when the motor drives the first drive rod 1 to rotate, it will take a short time for the annulus 11 to contact the annulus 14 such that the lower jaw portion 1000 stays for the same time in the closed state or in the opened state with respect to the upper jaw portion 2000. As a result, the lamp hanger looks very vivid.

Embodiment 2

Figure 3:
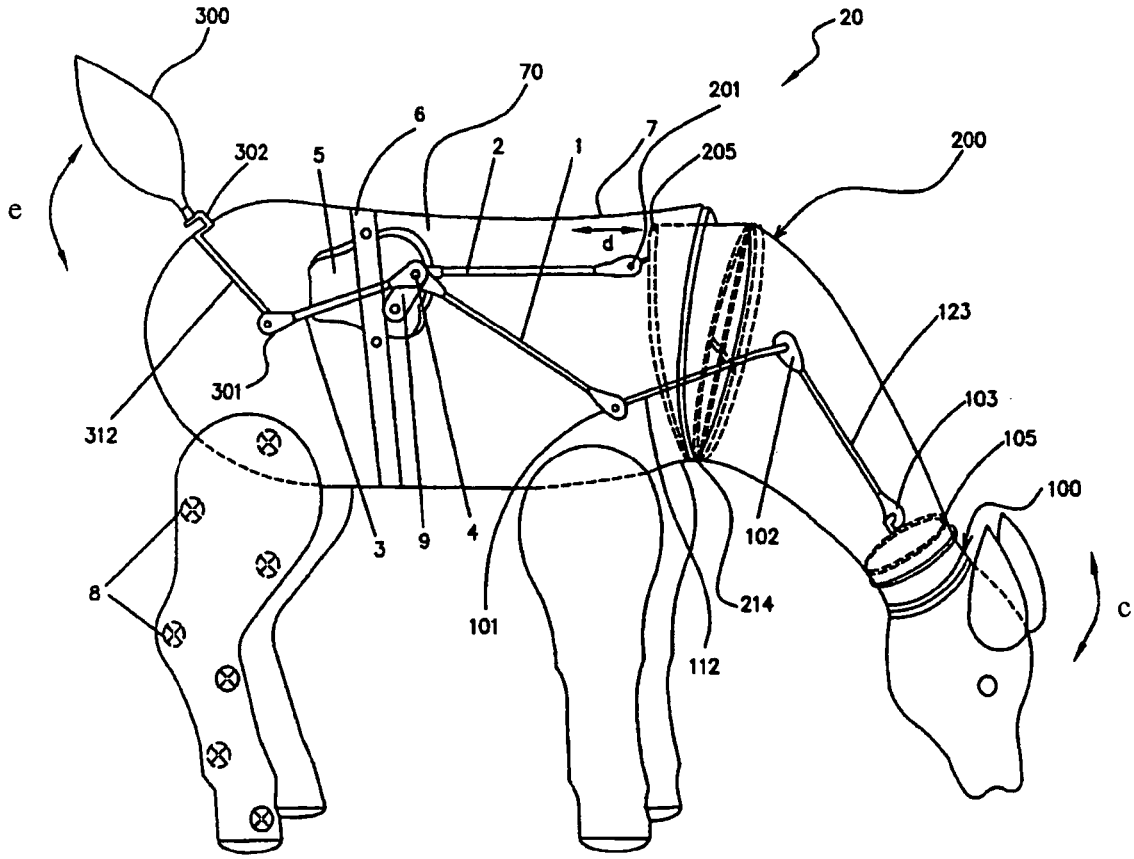
FIG. 3 shows another embodiment of the movable deer-like lamp hanger of the invention.

As shown in FIG. 3, a movable lamp hanger shaped like a deer 20 is provided in this embodiment. As those shown in the Embodiment 1, the lamp hanger 20 includes the hollowed body 7 which is shaped a grid configuration, a great number of small ornamental bulbs 8 are attached to the inside of the body, the motor 5 is fixed to the support 6 mounted within the body 7, and the transmission shaft 4 is connected to the motor 5 by the crank 9. In this embodiment, there are provided three movable portions. Besides the movable portions of the head portion and the tail portion, a movable neck portion is also provided.

The first drive rod 1 is connected to the head portion 100 by two connecting bars 112 and 123. The connecting bar 123 is connected to the head portion 100 with a gimbal 103.

The gimbal 103 is connected to a frame 105 mounted to the head portion 100. The connecting bar 112 is respectively connected to the first drive rod 1 and the connecting bar 123 with two gimbals 101 and 102. With such a structure, the head portion 100 of the deer can be driven to move in the direction of an arrow c as shown in FIG. 3.

The second drive rod 2 is connected to the neck portion 200 of the deer with a gimbal 201. The neck portion 200 connected to the head portion 100 of the deer can be driven to move forward and backward round a pivot 214 within the trunk 70 by the second drive rod 2, (in the direction of an arrow d as shown in FIG. 3).

A third drive rod 3 connected to the tail portion 300 of the deer by a connecting bar 312 is provided in this embodiment. A connecting bar 312 is connected to the tail portion 300 with a pivot 302 and connected to the third drive rod 3 with a gimbal 301 disposed at the body 7. The tail portion 300 of the deer can be driven to swing in the direction of an arrow e round the pivot 302 by the third drive rod 3.

Figure 1:
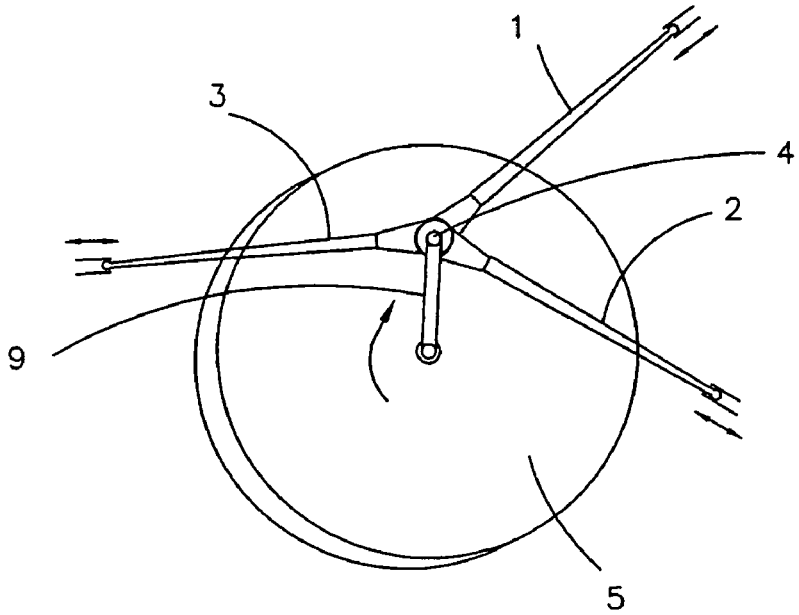
FIG. 1 schematically shows the working principle of the lamp hanger in accordance with the invention.

Also referring to FIG. 1, when the motor 5 rotates, the three drive rods 1, 2, 3 are driven to direct the head portion 100, the neck portion 200 and the tail portion 300 to move. Because the first drive rod 1 has a different length from the second drive rod 2 and the third rod 3, the movement of the three movable portions in this embodiment is not synchronous.

Because the body of the deer is shaped in the grip configuration, and a great number of ornamental small bulbs 8 are attached to the inside of the body, when the lamp hanger is arranged on the grass and is powered in the evening, it looks like a real deer in browsing.

Figure 5:
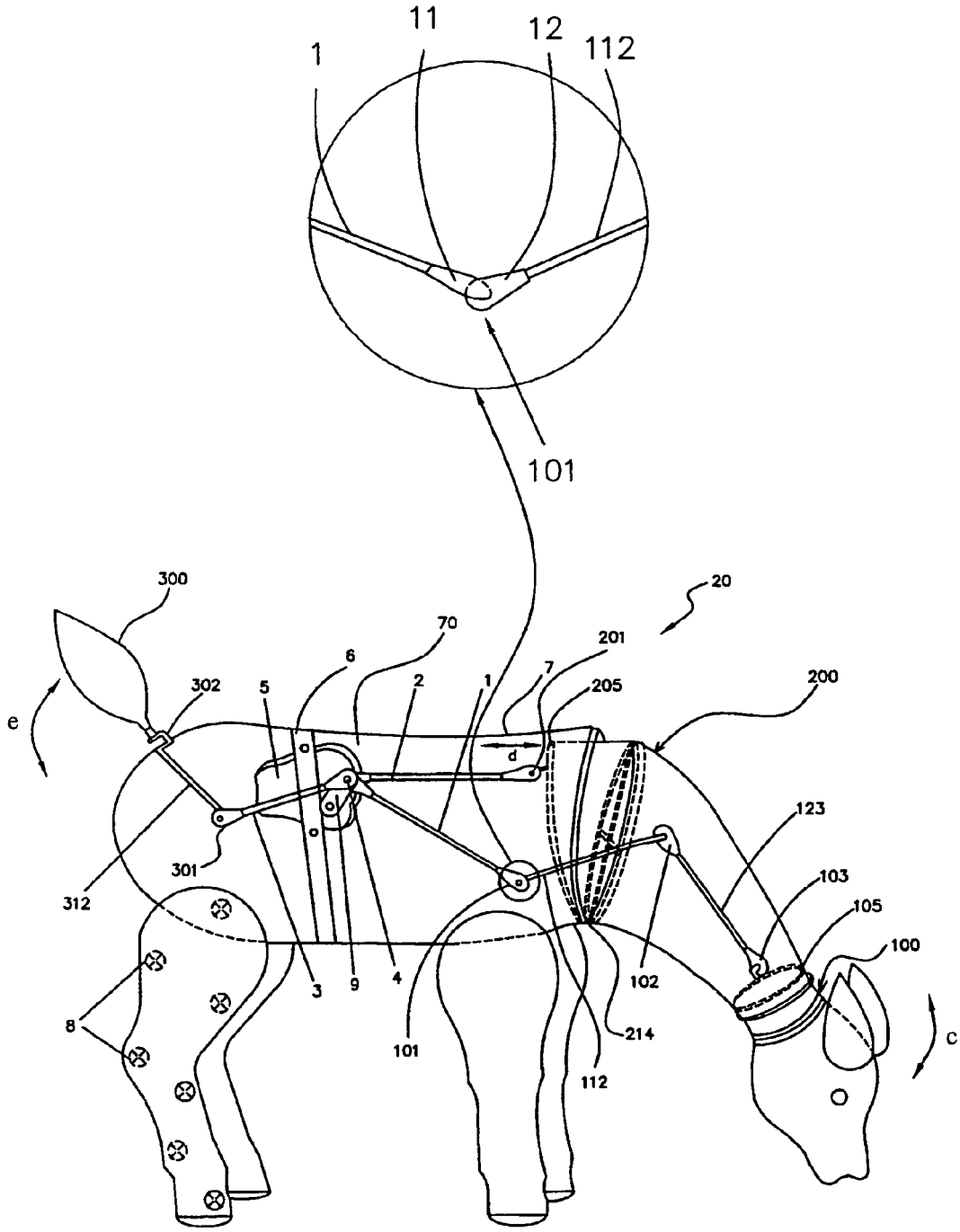
FIG. 5 shows another embodiment of the deer-like lamp hanger of the invention, which includes an enlarged view of a connecting member used.

In another embodiment of the deer-like lamp hanger of the invention as shown in FIG. 5, the connecting member 101 including two annuluses 11, 12 perpendicular to each other which is similar to that shown in FIG. 4 is provided. With such a structure, when the motor drives the first drive rod 1 to rotate, it will take a short time for the annulus 11 to contact the annulus 12 such that the head portion 100 stays in the lowest state or at the highest state with respect to the ground for the same time. As a result, the lamp hanger looks much vivid.

It is appreciated that the above embodiments and description are merely used to illustrate the present invention. Those skilled in the art will understand that alternatives, modifications, varieties or equivalents to the present invention can be made without departing from the spirit of the invention. The full scope of the invention is all the subject matter defined by the appended claims, and equivalents thereof.

The invention claimed is:

1. A movable animal-like lamp hanger comprising:

a body including a first movable portion;

a plurality of ornamental lights attached to said body;

a motor disposed in said body;

a transmission shaft connected to said motor; and a first drive rod pivotally connected to said transmission shaft and connected to said first movable portion of said body in such a manner that when said motor drives said transmission shaft to rotate, said first drive rod directs said first movable portion to move like a desired animal, wherein said first drive rod is connected with said first movable portion by a connecting member having two annuluses perpendicular to each other or a first gimbal.

2. The lamp hanger of the claim 1, wherein said body is in the shape of a grid configuration and said ornamental lights are attached to the inside of said body.

3. The lamp hanger of claim 1 further comprising a second drive rod pivotally connected to said transmission shaft, wherein said body further comprises a second movable portion which is connected to said second drive rod in such a manner that when the motor drives the transmission shaft to rotate, said first drive rod and said second drive rod respectively drives said first movable portion and said second movable portion to move like the animal, wherein said second drive rod is connected with said second movable portion by a second gimbal.

4. The lamp hanger of claim 3 further comprising a third drive rod pivotally connected to said transmission shaft, wherein the body further comprises a third drive rod which is connected to said third drive rod in such a manner that when the motor drives said transmission shaft to rotate, said first drive rod, second rod and third rod respectively drives said first, second and third movable portions to move like the animal, wherein said third drive rod is connected to said third movable portion by a third gimbal.

5. The lamp hanger of the claim 4, wherein said body is in the shape of a grid configuration and said ornamental lights are attached to the inside of said body.

6. The lamp hanger of the claim 3, wherein said body is in the shape of a grid configuration and said ornamental lights are attached to the inside of said body.

7. A movable frog-like lamp hanger comprising:

a body including a movable lower jaw portion and a movable tail portion;

a plurality of ornamental lights attached to said body;

a motor disposed in said body;

a transmission shaft connected to said motor;

a first drive rod pivotally connected to said transmission shaft and connected to said movable lower jaw portion of said body in such a manner that when said motor drives said transmission shaft to rotate, said first drive rod directs said movable lower jaw portion to move upward and downward; and a second drive rod pivotally connected to said transmission shaft and connected to said movable tail portion of said body in such a manner that when said motor drives said transmission shaft to rotate, said second drive rod drives said movable tail portion to move upward and downward, wherein said first drive rod is connected with the movable lower jaw portion of said body by a connecting member having two annuluses perpendicular to each other.

8. The movable frog-like lamp hanger of claim 7, wherein said body is designed in the shape of a grid configuration and said ornamental lights are attached to the inside of said body.

9. A movable deer-like lamp hanger comprising:

a body including a movable head portion, a movable neck portion and a movable tail portion;

a plurality of ornamental lights attached to the body;

a motor disposed in the body;

a transmission shaft connected to the motor;

a first drive rod pivotally connected to said transmission shaft and connected to said movable head portion of said body in such a manner that when said motor drives said transmission shaft to rotate, said first drive rod directs said movable head portion to move upward and downward;

a second drive rod pivotally connected to said transmission shaft and connected to said movable neck portion in such a manner that when said motor drives said transmission shaft to rotate, said second drive rod drives said movable neck portion to move forward and backward; and a third drive rod pivotally connected to said transmission shaft and connected to said movable tail portion in such a manner that when said motor drives said transmission shaft to rotate, said third drive rod can drive said movable tail portion to swing like a deer, wherein said first drive rod is connected with the movable lower jaw portion by a connecting member having two annuluses perpendicular to each other.

10. The movable deer-like lamp hanger of claim 9, wherein said body is designed in the shape of a grid configuration and said ornamental lights are attached to the inside of said body.

* * * * *